US005761857A

United States Patent [19]

Kaufman et al.

[11] Patent Number: 5,761,857

[45] Date of Patent: *Jun. 9, 1998

[54] LOT CONFIGURATION AND BUILDING POSITION AND METHOD FOR RESIDENTIAL HOUSING

[76] Inventors: Mark I. Kaufman; Donald J. Meeks, Jr., both of 15995 N. Barkers Landing, Houston, Tex. 77079

[ * ] Notice: The term of this patent shall not extend beyond the expiration date of Pat. No. 5,671,570.

[21] Appl. No.: 741,350

[22] Filed: Oct. 29, 1996

Related U.S. Application Data

[63] Continuation-in-part of Ser. No. 666,813, Jun. 19, 1996, Pat. No. 5,671,570.

[51] Int. Cl.[6] ..... E04H 1/00

[52] U.S. Cl. ..... 52/169.2; 52/169.3

[58] Field of Search ..... 52/169.2, 169.3

[56] References Cited

U.S. PATENT DOCUMENTS 3,417,526 12/1968 Lawson .

3,732,649 5/1973 Mehran .

*Primary Examiner*—Christopher Kent

*Attorney, Agent, or Firm*—Akin, Gump, Strauss, Hauer & Feld, L.L.P.

[57] ABSTRACT

A residential subdivision having plural adjacent building lots is provided with common property lines between lots which may have laterally offset portions extending between front and rear property lines. Residential dwelling units and vehicle garages or carports for each lot are placed a predetermined distance from the respective property lines to conform to regulatory requirements and to provide access to all sides of the dwelling units and garages or carports, respectively, for maintenance and repair without requiring access to adjacent properties. A dwelling unit on one lot and a garage, carport or other structure on an adjacent lot are aligned along a construction reference line placed in a predetermined position extending between front and rear property lines to provide error-free placement of structures on the respective lots. Fences may be provided extending between adjacent dwelling units on adjacent lots and extending along common property lines to the vehicle garages or carports such that a rear or backyard portion of each lot utilizes an easement which may be a somewhat L-shaped portion of an adjacent lot owned by others to provide a large unobstructed backyard space for each lot.

9 Claims, 4 Drawing Sheets

LOT CONFIGURATION AND BUILDING POSITION AND METHOD FOR RESIDENTIAL HOUSING

CROSS-REFERENCE TO RELATED APPLICATION

This application is a continuation-in-part of U.S. patent application Ser. No. 08/666,813, filed Jun. 19, 1996, now U.S. Pat. No. 5,671,570 issued Sep. 30, 1997.

FIELD OF THE INVENTION

The present invention pertains to a unique residential or commercial building lot configuration, building position on the lot, and method for locating buildings on adjacent lots.

BACKGROUND

The ever-increasing cost of urban land suitable for residential housing, as well as commercial building locations, has resulted in the development of land subdivision and building designs which provide for so-called "Z" lot developments. Residential housing developments, in particular, which provide Z lot subdivision of individual lots, have many advantages in utilizing available land while providing for individual housing units to be placed spaced apart from each other on adjacent lots. However, a long-standing problem pertaining to subdividing land into individual lots and building placement on the respective lots, concerns providing lot configuration and building placement thereon which will give each owner or resident suitable yard space while providing adequate space for ancillary buildings, such as attached or detached garages or carports, all while also providing for owner access to all sides of structures which are on each lot and meeting regulatory requirements regarding building setback from property lines and compliance with fire codes, for example.

Another problem pertaining to the development of individual adjacent lots in residential, as well as commercial, subdivisions relates to minimizing surveying errors with regard to placement of buildings on adjacent individual lots. Proper location of survey pins or stakes for establishing construction reference lines for properly positioning buildings on individual lots has been a vexatious problem in the construction industry and errors in placement of construction reference lines can cause long delays in seeking variances or exceptions to regulatory requirements, once a building has been improperly placed on a lot, or result in substantial costs for demolition of an improperly placed building and reconstruction of the building in the proper location.

Accordingly, several factors must be taken into consideration when subdividing land for residential housing wherein it is desirable to maximize the utilization of available land by placing residential dwelling units and garages or other vehicle parking or ancillary structures in such a way that will provide aesthetic appeal to the occupants of each dwelling unit, and will provide desirable backyard space, in particular. These factors must be considered while also providing lot configuration and building placement thereon which will conform to regulatory requirements, provide for minimizing surveying errors in properly locating the building footprints during construction of the buildings and comply with requirements of utility service providers. It is to these ends that the present invention has been developed.

SUMMARY OF THE INVENTION

The present invention provides an improved lot configuration and building placement thereon, particularly for residential dwelling units and ancillary buildings, including attached and detached garages, carports or parking decks. The invention provides for higher density dwelling placements as a result of ever increasing land costs while still providing large backyard areas for each dwelling unit. The present invention further provides an improved lot configuration and building placement thereon for multiple adjacent lots which are provided with detached dwelling units and attached or detached garages which have vehicle access from an alley on a side of the lots opposite the side which faces a street, roadway or other area.

In accordance with one aspect of the invention, plural adjacent lots are provided which extend between a street, roadway or other area and a second spaced apart roadway or vehicle entry, such as an alley, and which lots may be provided with respective lateral offset portions such that, at least the property lines along the sides of the lots have a somewhat Z-shaped or zig-zag configuration. Residential dwelling units are placed on the lots spaced from the property lines and outbuildings, such as attached or detached garages or carports, are also positioned on each lot spaced from at least the side property lines of each of the lots, respectively. The lot configuration and the building placement thereby provides for access to all sides of the buildings on a particular lot without requiring movement across neighboring lots and while meeting regulatory requirements regarding building setback from the property lines of each lot.

In accordance with another aspect of the present invention, a unique lot configuration and placement of buildings thereon is provided for multiple adjacent lots wherein occupants of dwelling units on respective adjacent lots have greater space available for aesthetic as well as normal residential usage purposes, even though the respective occupants do not own all of the property which they normally use.

In accordance with yet another aspect of the present invention, a unique arrangement of multiple adjacent residential building lots is provided together with placement of residential dwelling units and garages or carports thereon, respectively, which garages are accessible by a roadway, driveway or alley at the rear of the lots and wherein the garages are placed spaced from the property lines defining adjacent lots.

Further in accordance with the present invention, multiple adjacent residential building lots are provided together with placement of residential dwelling units and garages or carports thereon, respectively, and wherein an owner or resident of a dwelling unit on one lot is provided with an easement for normal use of a backyard space of that lot, which easement covers a portion of the adjacent lot and is delimited by a structure such as a carport or garage on the adjacent lot. On each of the lots, the fence lines follow the easement lines as well as the property lines in such a way that each lot has a larger backyard space usable to the owner or occupant of the lot to which the easement has been accorded.

Still further in accordance with the invention, there is provided a method for placing buildings, such as residential dwelling units and garages or carports, on adjacent lots of a residential subdivision wherein a building construction reference line is established in such a way as to minimize errors in placement of one or more buildings on a particular lot and similar buildings on an adjacent lot. In particular, the method provides for positioning a building on one lot in alignment with a building on an adjacent lot utilizing the same construction reference line. The survey measurements required for locating the construction reference line are uncomplicated and substantially eliminate errors in locating buildings on adjacent lots.

The present invention still further provides a unique arrangement of property lines for multiple adjacent lots in a subdivided parcel of land having detached residential dwelling units on each lot and garages for respective ones of the dwelling units and wherein the respective properties are fenced in such a way as to maximize usable back yard space for each residential dwelling unit while maintaining the aesthetic appeal of the adjacent dwelling units and the configuration of the subdivision.

Those skilled in the art will further appreciate the above-mentioned features and advantages of the invention together with other superior aspects thereof upon reading the detailed description which follows in conjunction with the drawings.

DESCRIPTION OF THE PREFERRED EMBODIMENTS

Figure 1:
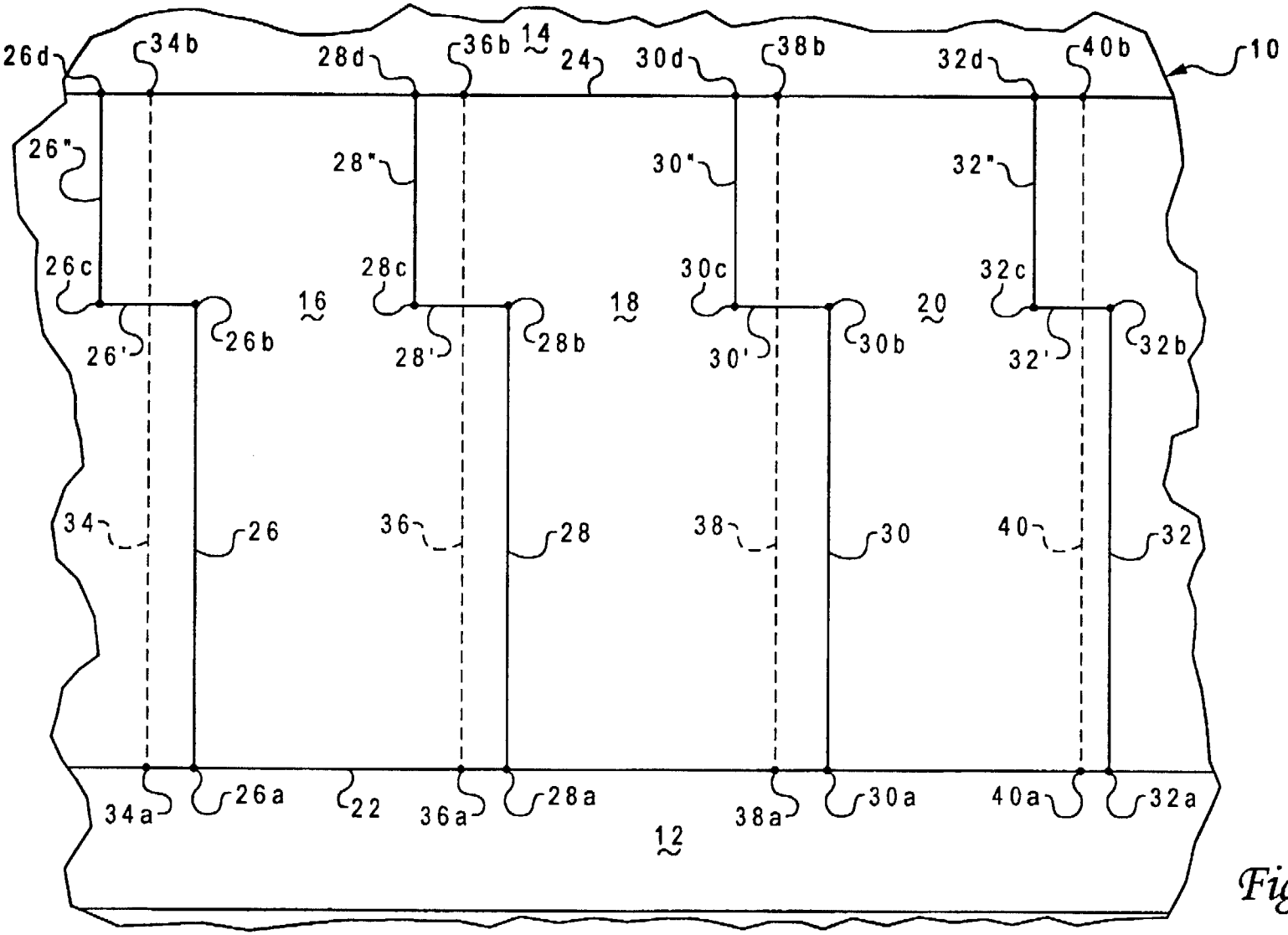
FIG. 1 is a plat of plural residential lots disposed between a street or roadway and a rear driveway or alley, which lots are configured in accordance with the present invention.

In the description which follows like elements are marked throughout the specification and drawing with the same reference numerals, respectively. The drawing figures are not necessarily to scale and the specific configuration of the subdivided lots is, in some respects, exemplary.

Referring to FIG. 1, there is illustrated a plat of a parcel of subdivided land 10 adjacent another parcel of land, such as a street or roadway 12, and disposed between the roadway and a generally parallel rear driveway, alley or other roadway 14, for access to the land parcel by motor vehicles. The particular subdivision of the land parcel 10 in accordance with the invention is such that a plurality of adjacent residential building lots 16, 18 and 20 have been platted, as shown, and which may be disposed between lots or land parcels having a similar or somewhat different configuration. The lots 16, 18 and 20 are delimited by a front property line 22 and a rear property line 24 which is shown parallel to the line 22 but is not necessarily required to be such. The "front" boundary or property line 22 may be adjacent another area, such as a so-called greenbelt area, instead of the street or roadway shown. Moreover, the property lines 22 and 24 are not necessarily required to be substantially straight lines, as shown. The lots 16, 18 and 20 are further delimited by spaced apart side property lines 26, 28, 30 and 32, which are shown parallel, but are not required to be, and which extend from respective property line or surveyor pins or stakes **26*a*, 28*a*, 30*a* and 32*a* on the property line 22, generally normal thereto to respective property line or surveyors pins or stakes 26*b*, 28*b*, 30*b*, and 32*b***.

The property lines of the respective lots 16, 18 and 20 are further defined by portions 26', 28', 30' and 32' extending normal to the property lines 26, 28, 30 and 32, respectively, between surveyor pins **26*b*, 28*b*, 30*b* and 32*b* and respective pins 26*c*, 28*c*, 30*c* and 32*c*. Further portions of the property lines delimiting the lots 16, 18 and 20 are indicated by numerals 26", 28", 30", and 32" and extend between property line survey stakes or pins 26*c* and 26*d*, 28*c* and 28*d*, 30*c* and 30*d*, and 32*c* and 32*d*, respectively. Accordingly, lot 16 is defined by a section of property line 22 between stakes 26*a* and 28*a*, property line 26, 26', 26", a section of property line 24 between stakes 26*d* and 28*d*, and property lines 28", 28' and 28. Lots 18 and 20 are similarly defined by respective sections of property lines 22 and 24 and property lines 28, 28', 28", 30, 30', 30", 32, 32' and 32", respectively. Accordingly, each lot 16, 18 and 20 has a section which is laterally offset from another section of the lot, as shown in FIG. 1. The lots 16 and 18 are of equal width and depth and the lot 20 is of equal depth with respect to lots 16 and 18 but is of reduced width with respect to lots 16 and 18. The specific configuration of lots 16, 18 and 20 with respect to width and depth is somewhat exemplary and the respective property lines 26, 28, 30 and 32** are not required to be substantially parallel to each other.

For sake of clarity, while referring further to FIG. 1, the plat of the land parcel 10 also shows an aspect of a method in accordance with the invention whereby a construction reference line or so called construction "string line" has been located for each of lots 16, 18 and 20 for use as a reference in locating certain buildings to be placed on each of the lots, such as a residential dwelling unit and an attached or detached garage. In accordance with the invention, a side edge of a dwelling unit on one lot and a side edge of an outbuilding, which may be a garage, carport or simply a vehicle parking pad or deck on an adjacent lot, are placed contiguous with one of the construction reference lines illustrated. By way of example, a first construction reference line 34 is defined extending parallel to property line 26 between a pin or stake **34*a* on property line 22 and a pin or stake 34*b* on property line 24. Construction line 34 is preferably positioned equidistant between pins 26*b* and 26*c*. In like manner, construction reference lines 36, 38 and 40 also extend between property lines 22 and 24. Construction reference line 36 extends generally parallel to property line 28, midway between pins 28*b* and 28*c* and is located by pins or stakes 36*a* and 36*b*. In like manner, construction reference line 38 is disposed parallel to property line 30, is located midway between pins 30*b* and 30*c* and extends between locating stakes or pins 38*a* and 38*b*. Finally, construction reference line 40 is disposed extending generally parallel to property line 32, is disposed midway between pins 32*b* and 32*c* and extends between locating pins 40*a* and 40*b***.

One advantage of locating the construction reference lines 34, 36, 38 and 40 resides in the fact that a surveyor or construction worker is only required to place the stakes or pins **34*a* and 34*b* defining the location of opposite ends of construction reference line 34, for example, a predetermined distance from the property line pins 26*a* and 26*d*. A cross reference to the location of the construction line 34, for example, may be obtained by measuring the distance between a string defining the line and the surveyor pins 26*b* and 26*c*. Placement of the construction string or reference lines 36, 38 and 40 is done with equal ease by positioning the stakes or pins for these Lines at pre-determined distances along the front and rear property lines 22 and 24 from the respective pins defining property lines 28, 30 and 32 while verifying the location of the strings of each reference line by measuring its position with respect to pins 28*b* and 28*c*, 30*b* and 30*c* or 32*b* and 32*c***, respectively.

Figure 2:
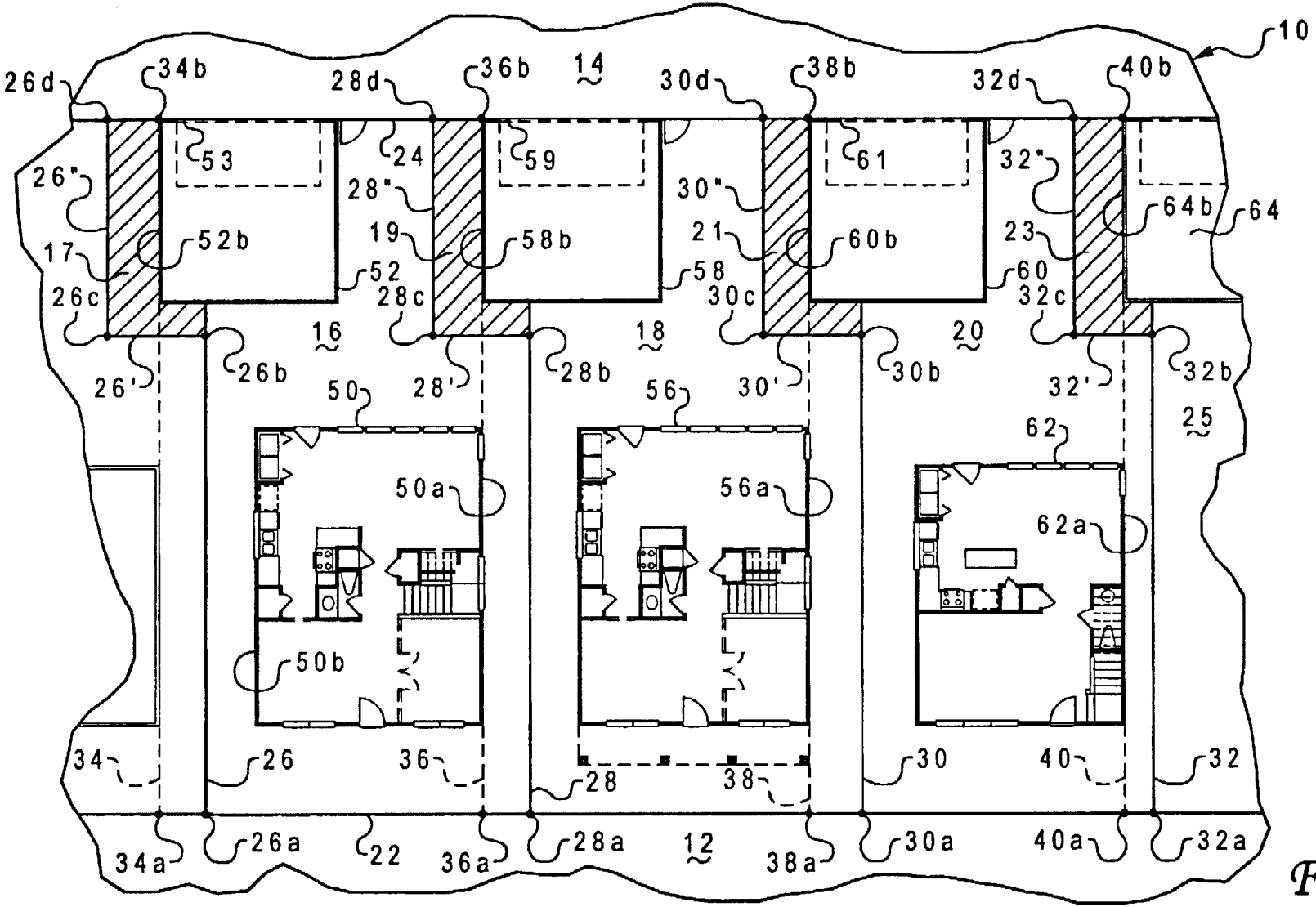
FIG. 2 is a plan view of the lots shown in FIG. 1 illustrating dwelling units and detached rear entry garages disposed on respective ones of the lots in accordance with the invention.

Referring now to FIG. 2, the lots 16, 18 and 20 are shown with respective buildings placed thereon in accordance with the invention. For example, lot 16 is illustrated with a residential dwelling unit structure 50 placed thereon at a required setback from property line 22 and at a requisite distance between property lines 26 and 28. A side edge 50a of dwelling unit 50 is shown placed along and contiguous with construction reference line 36. By way of example, the side edges **50*a* and 50*b* of dwelling unit 50 are also spaced equidistant between property lines 26 and 28. Lot 16 also has disposed thereon a rear entry vehicle garage 52 of generally rectangular configuration and having a side edge 52*b* placed along and contiguous with construction reference line 34. In this way, vehicle garage 52, which has a vehicle entry and exit opening 53 facing the roadway or alley 14, is also spaced from property line sections 26' and 26". A somewhat L-shaped shaded area of lot 16 is indicated by numeral 17 in FIG. 2. Similar, somewhat L-shaped portions of lots 18 and 20 are indicated in FIG. 2 and designated by numerals 19 and 21, respectively. A fourth, somewhat L-shaped area 23 is actually part of a lot 25 adjacent to lot 20**. As mentioned previously, the term garage as used herein may also refer to a carport or merely a concrete pad or other structure for parking vehicles thereon or the "garage" could be a structure used primarily for other purposes.

Referring further to FIG. 2, there is illustrated a residential dwelling unit building 56 disposed on lot 18, of generally rectangular configuration and having a side edge **56*a* extending parallel to and contiguous with construction reference line 38. Dwelling unit 56 is also preferably positioned equidistant between property lines 28 and 30 and is also at least setback from these lines a required regulatory or deed restricted distance. FIG. 2 also shows a detached vehicle garage 58 placed on lot 18 with a vehicle opening 59 facing alley 14 and with at least one side edge 58*b* of garage 58 extending parallel to and contiguous with construction reference line 36. Accordingly, construction reference line 36 may be used to locate building 50 on lot 16 as well as building 58 on lot 18. In like manner, construction reference line 38 is operable for locating building 56 on lot 18 and a building comprising a detached vehicle garage 60 on lot 20. Garage 60 includes a rear opening 61 facing alley 14 and a side edge 60*b* parallel to and contiguous with construction reference line 38**.

Still further, as shown in FIG. 2, a residential dwelling unit 62 is disposed on lot 20 and is positioned such that a side edge **62*a* is parallel to and contiguous with construction reference line 40. As further shown in FIG. 2, construction reference line 40 may be used to locate a side edge 64*b* of a building 64 on lot 25. Building 64 may also comprise a vehicle garage similar to the garages 52, 58 and 60**.

The placement of the garages 52, 58 and 60 is such that these buildings are spaced from the property lines of the respective lots on which they are situated so that the property owners may have access to all sides of the respective garages for maintenance or repair work, as needed, but for no other reason pursuant to deed restrictions, for example. On the other hand, the L-shaped areas represented by numerals 19, 21 and 23, for example, may be accessible to the occupants (or owners) of lots 16, 18 and 20, respectively, for normal usage of these areas as part of a backyard or lawn area, for example, even though these occupants or owners of lots 16, 18 and 20 are not the owners of the L-shaped areas 19, 21 and 23. Occupancy of the area 19, for example, by the owner or resident of dwelling unit 50 on lot 16 may be dictated by regulations, such as deed restrictions which permit certain uses of this area, and no fence extends along property line portions 28' and 28", for example. In fact, in a preferred arrangement of the buildings on the respective lots 16, 18 and 20, privacy fences extend between the respective dwelling units, generally parallel to the rear facing sides of these buildings, and then along the respective property lines 26, 28, 30 and 32 to be contiguous with the garages 52, 58, 60 and 64, respectively. Fences also, preferably, extend along the rear property line 24 between the respective garages 52, 58, 60 and 64 to give each resident of lots 16, 18 and 20 an enclosed backyard of suitable size.

Figure 3:
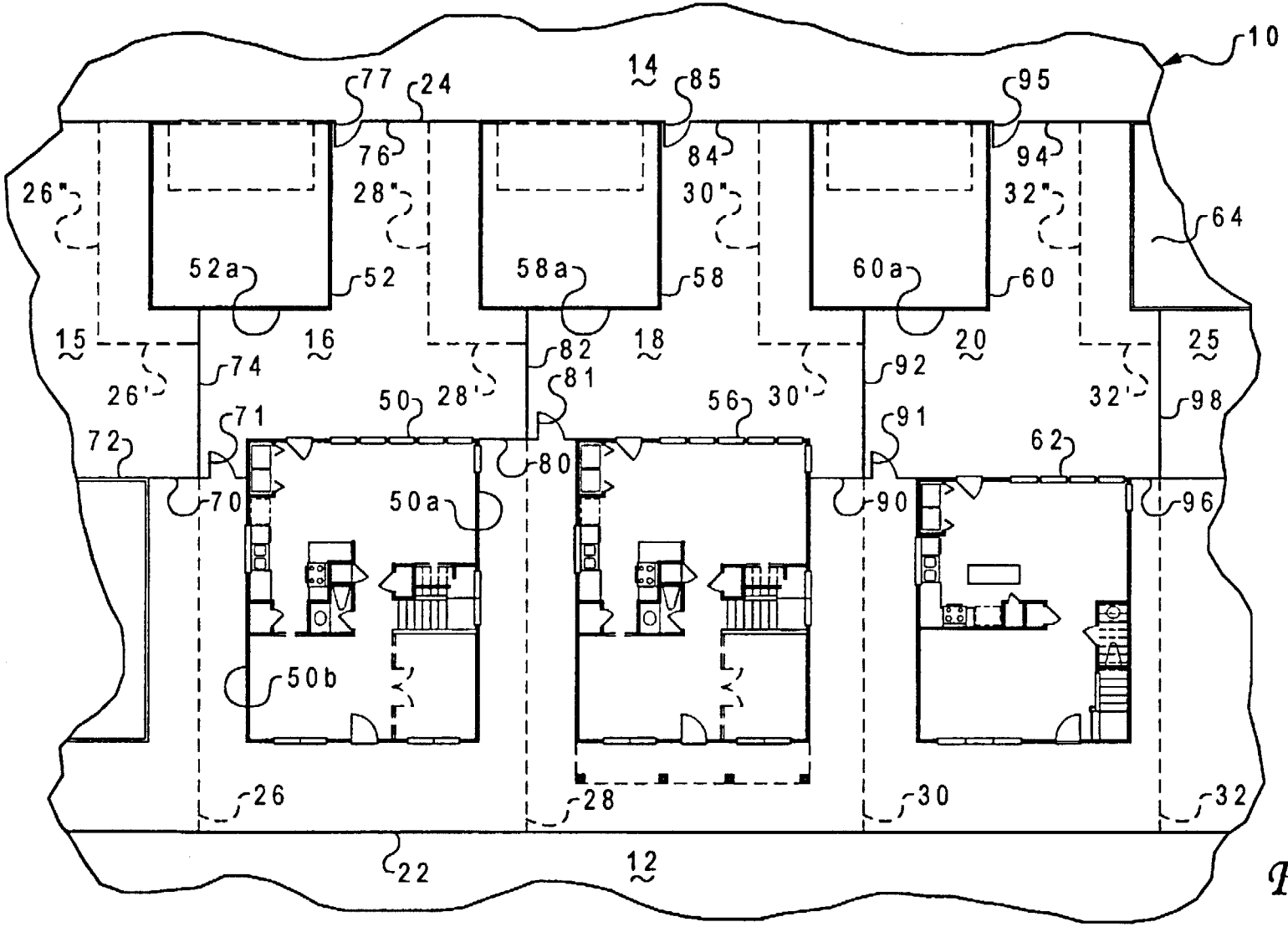
FIG. 3 is a plan view similar to FIG. 2 showing the location of fence lines for the respective lots.

Referring now to FIG. 3, the fences which enclose lot 16 include a fence 70 extending between a building dwelling unit 72 on a lot 15 adjacent to lot 16, which fence extends to side edge **50*b* of building 50. A suitable gate 71 is interposed in the fence 70 on lot 16. A fence 74 also extends along property line 26 to forward side edge 52*a* of garage 52 and a fence 76 extends parallel to, and preferably on, property line 24 between garages 52 and 58 with an access gate 77** interposed therein.

In like manner, a fence 80 extends between buildings 50 and 56, as shown in FIG. 3, having a suitable gate 81 for lot 18 interposed therein. A fence 82 extends along property line 28 between fence 80 and forward side edge **58*a* of garage 58. A fence 84 extends along property line 24 between garages 58 and 60 and has a suitable gate 85 opening to alley 14. A fence 90 extends between buildings 56 and 62 having an access gate 91 for lot 20 interposed therein. A fence 92 extends along property line 30 between fence 90 and forward side edge 60*a* of garage 60 and a fence 94 extends between garage 60 and garage 64 on lot 25 and having a gate 95 interposed therein opening to the backyard of lot 20. Fences 96 and 98, arranged similar to fences 90 and 92, along the opposite side of lot 20 provides closure for the backyard portion of lot 20 between building 62 and property line 32**.

Figure 4:
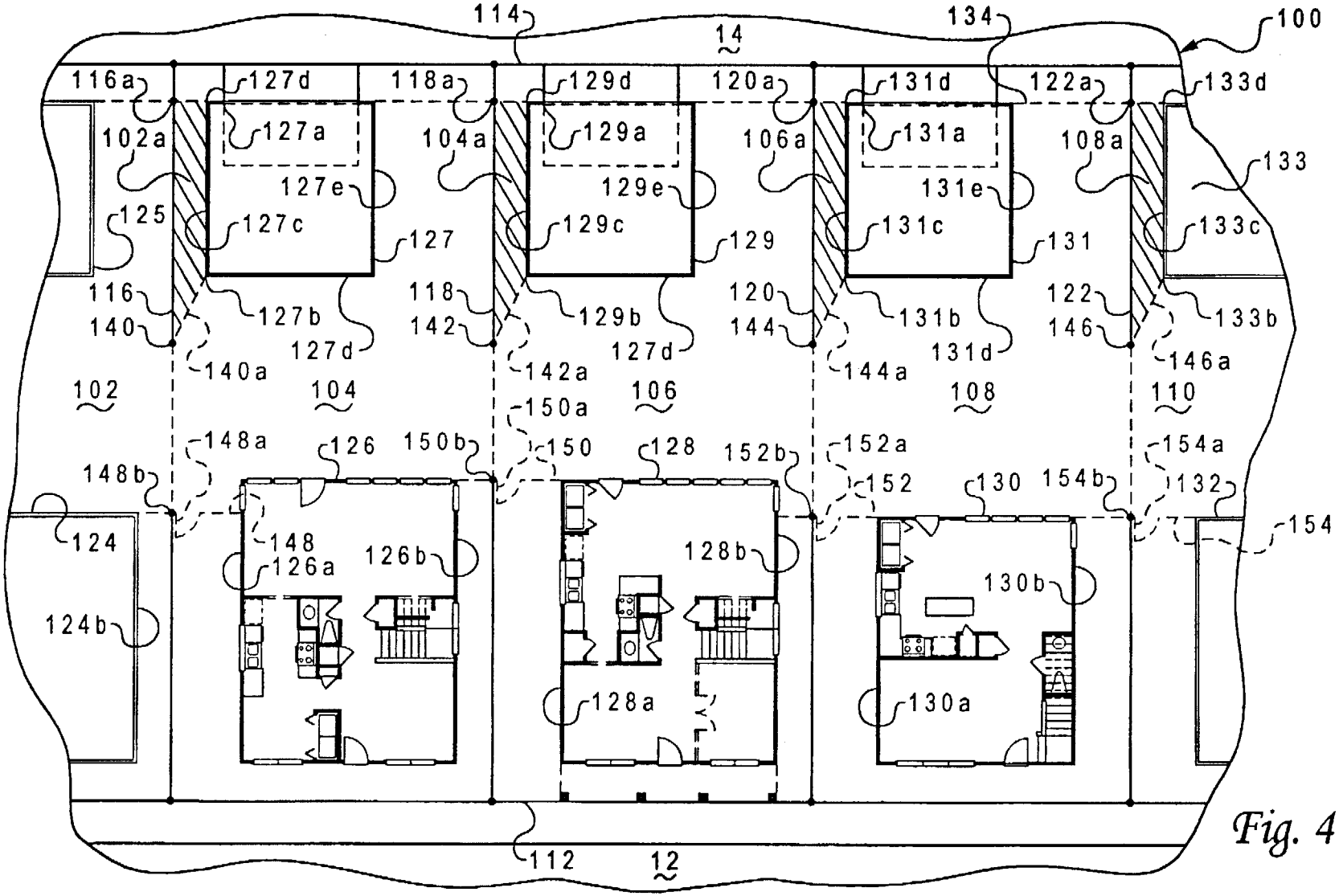
FIG. 4 is a plan view of plural residential lots having a property line and easement configuration in accordance with the invention.

Referring now to FIG. 4, a parcel of land 100 is illustrated wherein plural residential building lots 102, 104, 106, 108 and 110 are shown arranged substantially side-by-side and each being of generally rectangular configuration without the lateral offsets of the lots illustrated in FIGS. 1 through 3. For example, in the arrangement shown in FIG. 4 a common front property line 112 extends substantially parallel to a common rear property line 114. Property lines 116, 118, 120 and 122 extend between and connect to the property lines 112 and 114, as shown, are substantially parallel to each other and normal to the property lines 112 and 114 and define boundaries of the lots 102, 104, 106, 108 and 110. In particular, the substantially straight side property lines 116, 118, 120 and 122, together with the front and rear property lines 112 and 114, completely define lots 104, 106 and 108. A roadway 12 may be disposed spaced from the front property line 112 and a roadway or alley 14 may be contiguous with the rear property line 114. A roadway authority may own property contiguous with the property line 112 and between line 112 and roadway 12. Moreover, the property occupied by roadway 12 and that which is contiguous with the property line 112 may be other than a roadway, such as a greenbelt or the like.

The configuration of the lots 102, 104, 106, 108, and 110 is simplified for conformance with certain regulatory requirements and utility service provider requirements but enjoys the same benefits as the aforementioned lot configuration. For example, dwelling units 124, 126, 128, 130 and 132 are disposed on the respective lots 102 through 110, as shown, and are each spaced from each of the property lines defining the respective lots in conformance with regulatory requirements. Still further, vehicle parking structures comprising garages, carports or simple parking decks, each designated by numerals 125, 127, 129, 131 and 133, respectively, are disposed on the respective lots 102 through 110, as shown, and are spaced from the property lines defining the respective lots as indicated for the lots 104, 106, 108 and 110, in particular. Each of the vehicle garages, carports or parking decks 125, 127, 129, 131 and 133 are also shown contiguous with a setback line 134 from the property line 114, by way of example. This setback line may, of course, vary or not exist, depending on regulatory requirements for a particular sub-division. Each of the garages, carports or parking decks have vehicle access portions or openings 127*a*, 129*a* and 131*a*, for example, which provide vehicle access between the associated garage, carport or deck and the roadway or alley 14 to provide a so-called rear entry arrangement for vehicles parked by the owners or residents of the respective lots on which the garages or carports are disposed.

Referring further to the plat of FIG. 4, the lot configurations illustrated are advantageous in that limited use areas or easements 102*a*, 104*a*, 106*a* and 108*a* are provided for the respective lots 102, 104, 106 and 108, which provide for increasing the usable backyard space of the owners or occupants of the dwelling units 124, 126, 128 and 130, for example. The easement 102*a*, for example, extends from a point 140 on property line 116 along line 140*a* to a front corner 127*b* of the structure comprising garage or carport 127, along the side 127*c* of the structure 127 to a rear corner 127*d*, then along the setback line 134 to the intersection of the setback line with property line 116, as indicated at point 116*a*, and then along property line 116 between point 116*a* and point 140.

In like manner, the easement 104*a* is defined by a point 142 on property line 118 along a line 142*a* to corner 129*b* of structure of 129, along structure side 129*c* to corner 129*d*, then along the setback line 134 to a point of intersection 118*a* with property line 118 and then along property line 118 to point 142. The easements 106*a* and 108*a* are similarly defined by the respective points 144 and 146, lines 144*a* and 146*a*, the sides of the structures 131 and 133, the setback line 134, the points 120*a* and 122*a* and the property lines 120 and 122, respectively, as shown.

The respective lots or properties, by way of example, 104, 106 and 108, may be further provided with privacy fencing following fence lines as shown in FIG. 4. By way of example, the lot 104 may include a privacy fence 148 extending between side 126*a* of dwelling unit 126 and side 124*b* of dwelling unit 124. An access gate 148*a* may be provided for lot 104. Privacy fencing may run from point of intersection 148*b* on property line 116 along property line 116 to point 140 and then along line 140*a* to point 127*b*. A fence also runs along setback line 134 between structures, such as garages 125 and 127, between garages 127 and 129 and between garages 129 and 131 or, in other words, along setback line 134 between each of the garage structures. A privacy fence runs along line 150 between structures 126 and 128, as shown, and a gate 150*a* is provided for lot 106. A fence also runs along property line 118 between point 150*b* on line 118 and point 142 and along line 142*a* between point 142 and point 129*b*. Accordingly, the owner and/or resident of the dwelling unit 126 has a backyard usable space, which may be enclosed by fencing as described. Such usable space, excluding the area occupied by structure 127, is delimited by a fence which runs from the side of dwelling unit 126 to point 148*b*, then to point 140 along property line 116, then along line 140*a* to point 127*b*, by structure sides 127*d* and 127*e* and a fence along the setback line 134 between garage or carport structures 127 and 129. The boundary for backyard space for lot 104 is further defined by side 129*c* of structure 129 and a fence along line 142*a* between points 142 and 129*b* and then along property line 118 between points 142 and 150*b* and then along fence line 150 from point 150*b* to the side 126*b* of dwelling unit 126.

The usable backyard spaces for lots 106 and 108 are similarly provided and may be enclosed by fencing. For example, fence 150 also extends between side 128*a* of dwelling unit 128 to point 150*b*, and includes gate 150*a*, and then along property line 118 to point 142, then along line 142*a* between point 142 and 129*b*. A fence also extends along line 134 between garages or carports 129 and 131, along a line 144*a* between points 131*b* and 144 and along property line 120 between points 144 and 152*b* and then between point 152*b* and the side 128*b* of dwelling unit 128. Sidewall 131*c* also serves as a boundary for usable space for lot 106. Garage sides 129*d* and 129*e* may delimit the backyard space for lot 106, for example, but the areas occupied by the vehicle parking structures may be part of the usable space for each lot on which the structures are disposed, respectively, if the structure is a carport or deck. If structures 127, 129 and 131, for example, are not walled themselves suitable gates may be provided across vehicle entry openings 127*a*, 129*a* and 131*a*.

The backyard space of lot 108 may be similarly enclosed by a fence 152 between side 130*a* of dwelling unit 130 and point 152*b*, fencing extending between point 152*b* and point 144, then along line 144*a* between point 144 and point 131*b*, the sidewalls 131*d* and 131*e* of structure 131, a fence between garage or carport structure 131 and garage or carport structure 133 along line 134, the garage sidewall 133*c*, a fence between point 133*b* and point 146 along line 146*a* and along property line 122 between point 146 and point 154*b* and then between point 154*b* and the side 130*b* of dwelling unit 130. Of course, if the garages 127, 129, 131 and 133 are open carports, parking decks, or the like, then a fence could extend along the sides 127*c*, 129*c*, 131*c* and 133*c* to form a complete enclosure for the backyard spaces of the respective lots 102, 104, 106 and 108, for example.

Another advantage of the lot configuration and building placement thereon, shown and described in conjunction with FIG. 4, is that each of the buildings on a lot are set back from the property lines, if required to meet local code requirements, and a portion of the property between the outbuildings, such as the garages, shown and described and the side property lines nearest thereto may be used by the owner and/or resident of the adjacent property, with certain restrictions, while the owner of the property on which the building is placed also has the right of access to all sides of the building for maintenance or repair thereof, as needed.

Those skilled in the art will appreciate from the foregoing description that the unique lot configurations, building position, and method for locating buildings on respective adjacent lots, in accordance with the invention, provides certain advantages. For example, land suited for residential development may be subdivided in a way wherein land use is maximized while providing for placement of buildings on respective subdivided lots which offer several advantages including those described hereinabove. The specific configurations of the dwelling unit buildings and outbuildings, such as attached or detached garages or carports, may be varied and conventional construction techniques may be utilized for such buildings. By configuring the property lines which are common to the adjacent lots, as described above, and by placing the buildings on the respective lots in the manner set forth herein, each dwelling unit has the appearance of being spaced a suitable distance from each other dwelling unit and rear entry garages, in particular, are placed on each lot in a manner which is aesthetically pleasing and provides maximum usable backyard space for each property owner or dwelling occupant. More-over, the lots are configured in such a way that the buildings are set back from the actual property lines to conform to regulatory requirements and to provide access to the buildings by the property owners for maintenance and repair.

Although the exemplary lot configurations shown in the drawing figures are generally rectangular, with and without offset rectangular portions, those skilled in the art will recognize that, as mentioned above, the side property lines for example, are not required to be parallel to each other. The lots may be placed on a curved street, cul-de-sac or otherwise located in such a way that the lots are not strictly rectangular and of equal depth, as shown by example. Moreover, the arrangement and method of the invention may also be utilized for locating non-residential type buildings on adjacent lots configured in accordance with the invention, if desired, although the invention is particularly advantageous for residential developments which are subdivided to provide relatively small lots for each residential unit.

Although preferred embodiments of the invention have been described in detail herein, those skilled in the art will recognize that various substitutions and modifications may be made to the invention without departing from the scope and spirit of the appended claims.

What is claimed is:

1. In a subdivision having a plurality of adjacent lots, an area delimiting a first property line of said lots and a roadway adjacent to a second property line of said lots and spaced from said first property line, said lots each being further defined by third and fourth property lines defining side edges of respective ones of said lots extending between said first and second property lines, the improvement comprising:

first buildings disposed on at least selected ones of said lots and spaced from said property lines; and additional buildings disposed on respective ones of said selected ones of said lots adjacent to said roadway, said additional buildings being spaced from said third and fourth property lines a predetermined distance, respectively, and said selected ones of said lots each include a permitted usable space delimited by a first building on said each lot, said second property line, said second building on said each lot and a second building on an adjacent lot.

2. In a subdivision having a plurality of adjacent lots, an area delimiting a first property line of said lots and a roadway disposed adjacent to a second property line of said lots spaced from said first property line, said lots being further defined by third and fourth property lines defining side edges of respective ones of said adjacent lots and extending between said first and second property lines, the improvement comprising:

vehicle parking structures positioned on at least selected ones of said lots, each of said vehicle parking structures being disposed at a predetermined distance from said second property line and one of said third and fourth property lines defining a side edge of a lot on which said vehicle parking structures are disposed, respectively; and an area within each lot on which a vehicle parking structure is disposed, respectively, located between said one property line defining said side edge and said vehicle parking structure and forming part of a permitted usable space of an adjacent lot.

3. The invention set forth in claim 2 wherein:

said area is further defined by a fence extending between said one property line defining said side edge and said vehicle parking structure.

4. The invention set forth in claim 3 wherein:

said fence extends from said one property line defining said side edge to a near corner of said vehicle parking structure.

5. The invention set forth in claim 3 wherein:

said fence extends between said vehicle parking structure on said one lot and a vehicle parking structure on said adjacent lot and across said one property line defining said side edge of said one lot.

6. The invention set forth in claim 3 wherein:

each of said lots includes a backyard space delimited by a dwelling unit on each of said lots and positioned on each of said lots a predetermined distance from said vehicle parking structure, a fence extending between said dwelling unit and a property line defining one side edge of a lot and extending between a point of intersection with said fence and said property line defining said one side edge along said property line defining one side edge to a predetermined point, and then from said predetermined point to another predetermined point on said vehicle parking structure.

7. The invention set forth in claim 6 wherein:

said fence extends from a vehicle parking structure on an adjacent lot to a point on the other of said property lines defining said side edges of said one lot and along said other property line to a point adjacent said dwelling unit and then between said point adjacent said dwelling unit and said dwelling unit to provide an enclosable space defined by said fence, said dwelling unit on said one lot, said vehicle parking structure on said one lot and a vehicle parking structure on an adjacent lot.

8. The invention set forth in claim 2 wherein:

said vehicle parking structures include vehicle entries opening toward said roadway.

9. A residential subdivision comprising a plurality of adjacent lots defined by:

a first property line;

a second property line spaced from said first property line;

spaced apart property lines extending, respectively, between said first and second property lines and delimiting respective ones of said adjacent lots;

each of said lots including a dwelling unit disposed thereon and spaced a predetermined distance from said property lines;

each of said lots including a vehicle parking structure disposed thereon adjacent said second property line and including a vehicle entry opening toward a roadway adjacent to said second property line;

an easement area between said vehicle parking structure on each lot and a property line defining a boundary between each lot and an adjacent lot; and a boundary fence extending along said side property lines and along boundaries of said easement area for each lot and along said second property line between adjacent vehicle parking structures wherein each lot has a usable space delimited by said fence, said vehicle parking structures, said dwelling unit and one of said easement areas.

* * * * *